US006039200A

United States Patent [19]

Armor

[11] Patent Number: 6,039,200

[45] Date of Patent: Mar. 21, 2000

[54] LEG OPERATED TRASH BARREL LID CONTROLLER

[76] Inventor: Francis L Armor, 5361 Berkeley Ave., Westminster, Calif. 92683

[21] Appl. No.: 08/783,437

[22] Filed: Jan. 16, 1997

Related U.S. Application Data

[60] Provisional application No. 60/010,639, Jan. 26, 1996.

[51] Int. Cl.[7] ..... B65F 1/16

[52] U.S. Cl. ..... 220/263; 220/908

[58] Field of Search ..... 220/264, 263, 220/262, 908, 909

[56] References Cited

U.S. PATENT DOCUMENTS

| | | | |
|---|---|---|---|
| 433,233 | 7/1890 | Byrom | 220/264 |
| 1,195,481 | 8/1916 | Legat et al. | 220/264 |
| 1,199,531 | 9/1916 | Davis | 220/264 |
| 1,251,984 | 1/1918 | Losoncy | 220/264 |
| 2,639,113 | 5/1953 | Kriz | 220/264 |
| 4,593,873 | 6/1986 | Nelson | 220/263 |
| 4,892,218 | 1/1990 | Reiling | 220/263 |
| 5,048,712 | 9/1991 | Wolters | 220/263 |
| 5,531,348 | 7/1996 | Baker et al. | 220/264 |

*Primary Examiner*—Stephen J. Castellano
*Attorney, Agent, or Firm*—David Pressman

[57] ABSTRACT

A separate, self contained, lever mechanism which may be placed adjacent to the front of large residential trash barrels with lids hinged at the back of the barrel, for creating hands free assistance in opening and closing the lid. Vertical push rods of the mechanism may be temporarily attached to the edge of the lid on both sides by means of pivotal linkage to lid attaching assemblies. This permits the opening and closing of the trash barrel lid to be controlled by the positioning of the lever mechanism which is controlled by either leg of the user. Pressing down on the lever opens the lid to any desired amount. Reducing foot pressure on the lever permits the user to control the closing of the lid using the force of gravity. To accommodate periodic emptying of the trash barrel, the lid attaching assemblies are released and the trash barrel may be rolled away for emptying.

5 Claims, 6 Drawing Sheets

LEG OPERATED TRASH BARREL LID CONTROLLER

CROSS REFERENCE TO RELATED APPLICATIONS

This application to invent was preceded by Provisional Patent Application 60/010639 dated Jan. 26, 1996, which had the title SELF SUPPORTED, FOOT OPERATED TRASH BARREL LID LIFTER. I have taken the liberty to delete the first two words of that title as being unnecessary and to change the word foot to leg and lifter to controller for greater accuracy. The design remains as presented in the Provisional Patent Application.

STATEMENT REGARDING FEDERALLY SPONSORED RESEARCH OR DEVELOPEMENT

Not applicable.

REFERENCE TO A MICROFICHE APPENDIX

Not applicable.

BACKGROUND OF THE INVENTION

This invention relates to residential trash collection systems many of which are becoming automated. The automation can be described as the introduction of sophisticated equipment incorporated into newly designed trash collection trucks. Each truck is manned by a single individual in the drivers seat on the right hand side of the truck. In addition to driving the truck, this person operates the controls which empty the trash barrels placed at the curb in front of residences. The controls manipulate what best can be described as "grabber arms" which move out from the truck and close horizontally around the mid section of the body of the trash barrel. The mechanism then lifts the barrel high over the truck, rotates it 180 degrees so that the lid falls open and the trash falls into the truck. If any trash sticks in the barrel, the operator can shake the barrel vigorously. The emptying being complete at this point, the barrel is rotated to its initial position, placed back on the curb and released from the truck mechanism.

This new way speeds up trash collection and reduces costs for the city. This new way however mandates only one trash barrel per residence, replacing two or three with the previous system. Having only one means it must be much larger. For uniformity the city owns and distributes these 100 gallon range trash barrels.

These trash barrels are made of heavy durable plastic, generally round in shape with a flat bottom and sides which are divergent from bottom to top creating a large opening thus requiring a large lid, which is hinged at the back of the barrel.

Shortly after we received our trash barrel in 1995 I experienced the awkwardness of controlling the lid when emptying the trash. I had an idea which I thought might make it easier. I built a crude prototype leg operated lifter and lo and behold when I attached it to the trash barrel and pushed down on the lever I was pleasantly surprised at the way the lid popped all the way open with so little leg force. This first design was to be permanently attached to the trash barrel, but that concept was quickly abandoned because it became evident that no hardware mounted on the trash barrel during the emptying process would likely survive the vigorous mechanical handling. Also with the city now owning the trash barrel, permission to attach anything might be difficult to obtain.

After many refinements I settled on a specific design, which would embody a platform mounted self contained lever mechanism completely separate from the trash barrel. Working alone in my garage I have made twenty five of these and about half are in use by others who have learned about it by word of mouth. All have expressed satisfaction and none have been returned. With regard to the future I feel I'm a little too old to start a business so I will be searching for a manufacturer who can make the platform base and pylons with one injection mold and perhaps do the same for the lever assembly.

With regard to PRIOR ART; No prior art in connection with these plastic trash barrels is in evidence, however it may be that the automated trash collection system requiring the large trash barrels is relatively new or it may be that anyone interested may have deemed it unworkable in this case. All prior art of which I am familiar has designed the lid lifting mechanism to be integral with the receptacle, having parts permanently attached whereas the invention proposed here almost has to be an entirely separate piece of equipment due to the mechanical handling of the trash barrel during the emptying process.

BRIEF SUMMARY OF THE INVENTION

There is difficulty in opening and holding open the hinged lid of a large size trash barrel and at the same time emptying a smaller container into the large trash barrel which usually requires both hands. The LEG OPERATED TRASH BARREL LID CONTROLLER permits a person to push down on the lever and hold the lid wide open with either leg thus giving complete freedom for both hands to be used to empty a smaller container. The lid can then be lowered smoothly to the closed position by slowly lifting the leg.

My objective is to satisfy what I feel is a "need" to give people complete freedom for both hands when emptying smaller containers into the large trash barrels. This would be especially helpful for little people such as children who are frequently assigned the task of emptying trash receptacles.

REFERENCE NUMERALS IN DRAWINGS

| | |
|---|---|
| 10 base | 24 "U" shaped holders |
| 12 lever assembly | 30 lid cradle |

-continued

| | |
|---|---|
| 14 lid attaching assembly | 32 roller assembly |
| 16 pylon support | 34 hinge pin |
| 18 leg operated lever | 36 rotation handle |
| 20 lifting arms | 38 roller |
| 22 vertical push rods | |

DETAILED DESCRIPTION OF THE INVENTION

The leg operated trash barrel lid controller is a mechanism which employs the science of mechanical advantage by way of using leverage to create an output of less force, but greater linear motion than the input. This is accomplished by the use of leg force moving a short distance and transmitted by way of a lever assembly to produce a smaller force moving a greater distance. This smaller force is sufficient to lift the large lid to the full open position.

Figure 1:
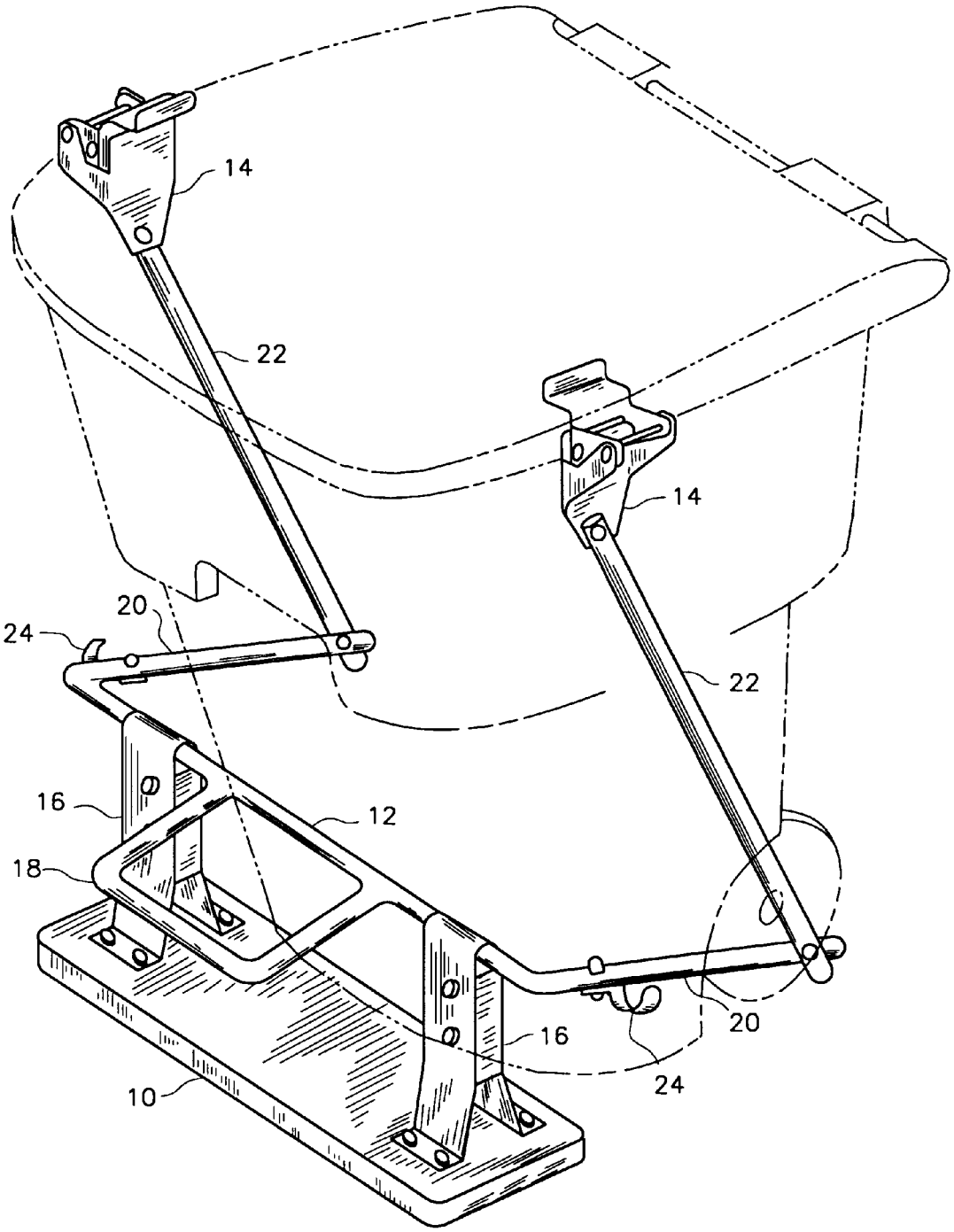
FIG. 1 is a perspective view of the lid controller as it would appear when attached to the closed lid of a trash barrel.
Figure 2:
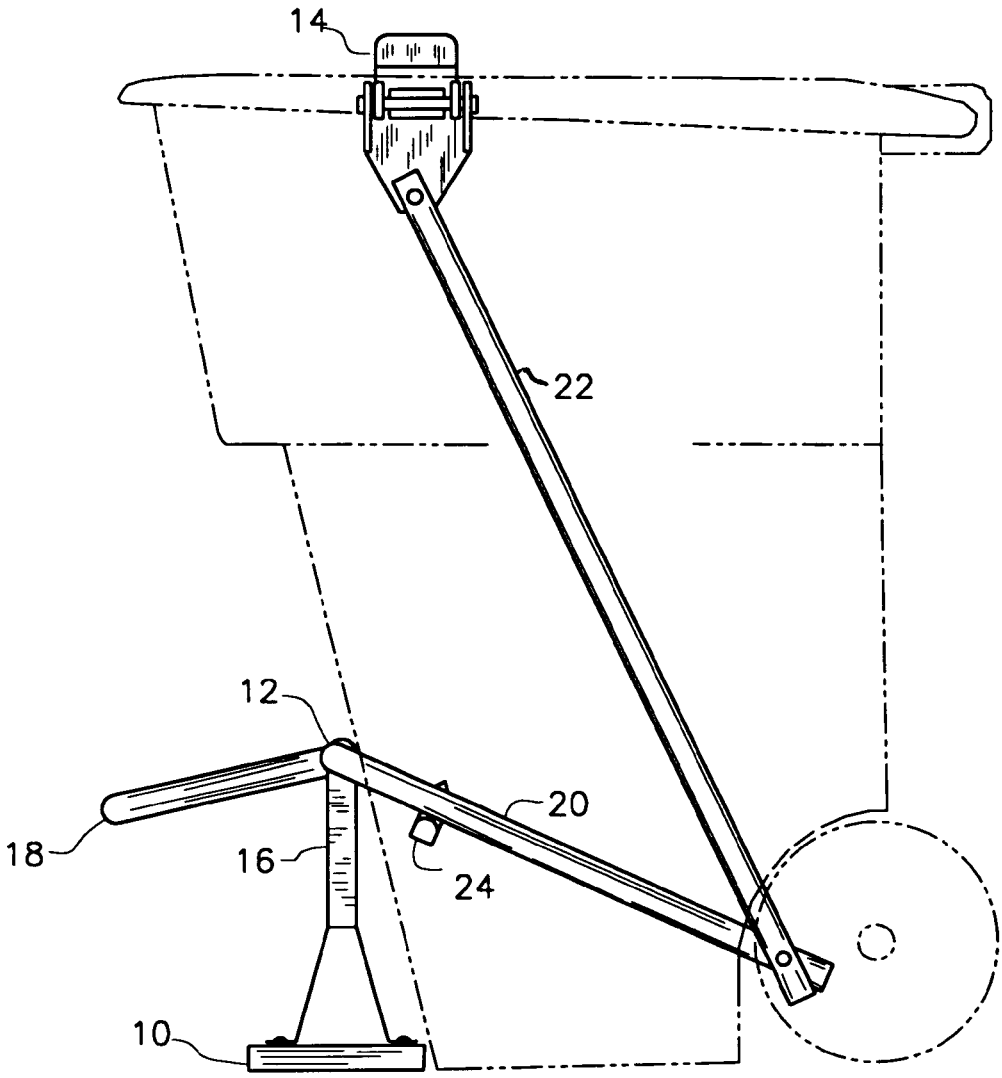
FIG. 2 is side elevation of the lid controller attached in the operative mode showing the position of the lever mechanism with the lid in the closed position.
Figure 3:
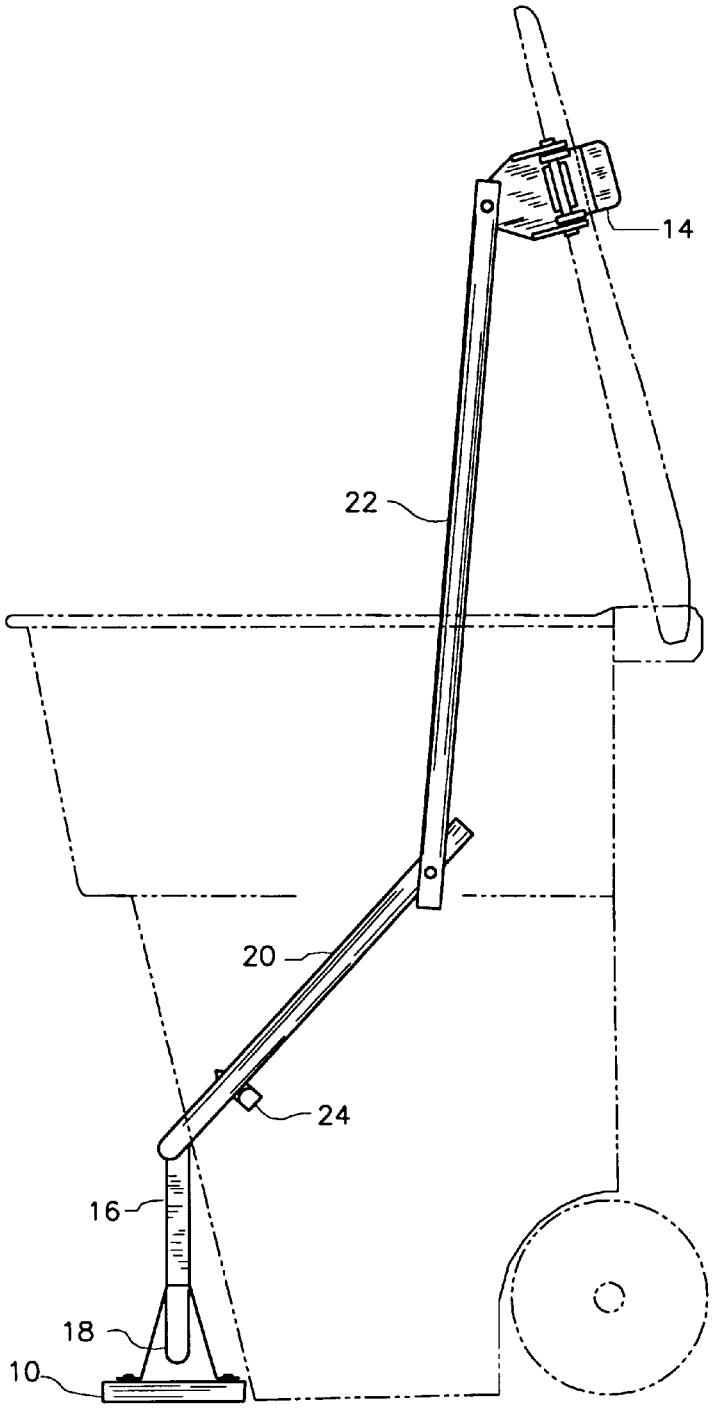
FIG. 3 is a side elevation of the lid controller showing the position of the lever mechanism with the lid in the wide open position.
Figure 4:
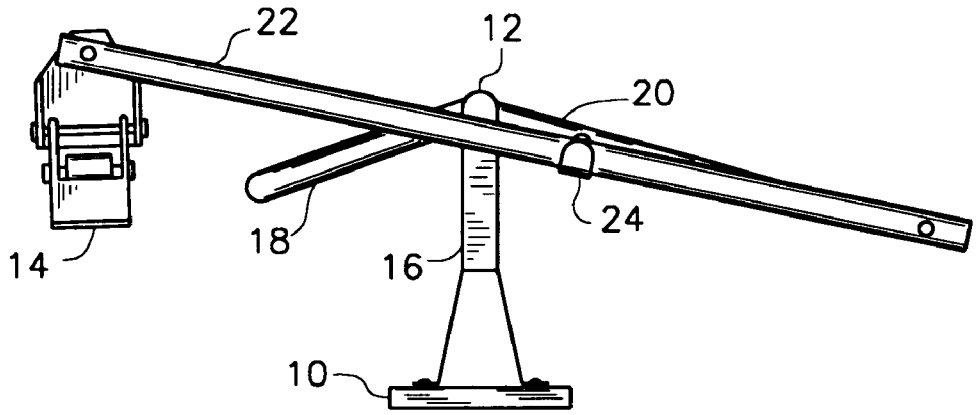
FIG. 4 is a side elevation of the lid controller when it is not in use and is in the stored configuration.

Referring to FIG. 1, the lid controller is composed of four major components, a base 10, a lever assembly 12, and two lid attaching assemblies 14, one for each of the two sides of the trash barrel lid. The following is a description of eash of these.

The base 10 consists of a flat platform on which are rigidly mounted two vertical pylon supports 16. Each pylon provides an enclosure at the top to serve as bearings for the journals of the lever assembly 12.

The lever assembly 12 consists of a rotary axle or shaft supported at two journal locations by the base vertical pylons. Rigidly attached to the rotary axle and projecting away from the front of the trash barrel is the leg operated lever 18. Also rigidly attached and extending from the ends of the rotary axle to either side of the trash barrel are two lifting arms 20. Attached to the ends of each of the lifting arms by means of rotatable connectors are vertical push rods 22. The two push rods each have a rotatable connection at the top end for connecting to the lid attaching assemblies 14. Mounted on each lifting arm 20 is a "U" shaped holder 24 for the purpose of supporting the push rods when the lid controller is not in use and is separated from the trash barrel.

Figure 5:
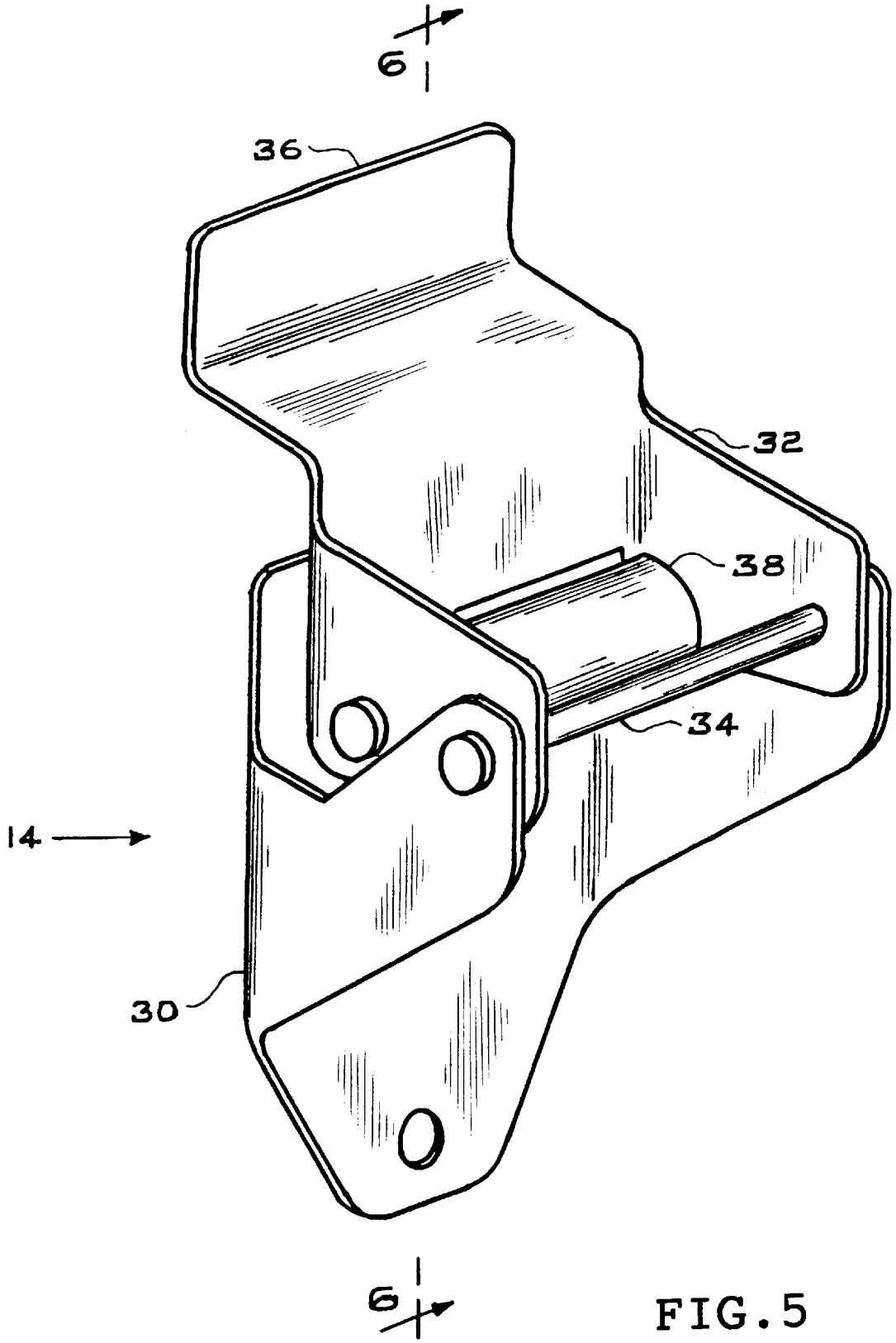
FIG. 5 is a perspective view of the lid attaching assembly of which there are two for the purpose of gripping the edge of the trash barrel lid on both sides.
Figure 6:
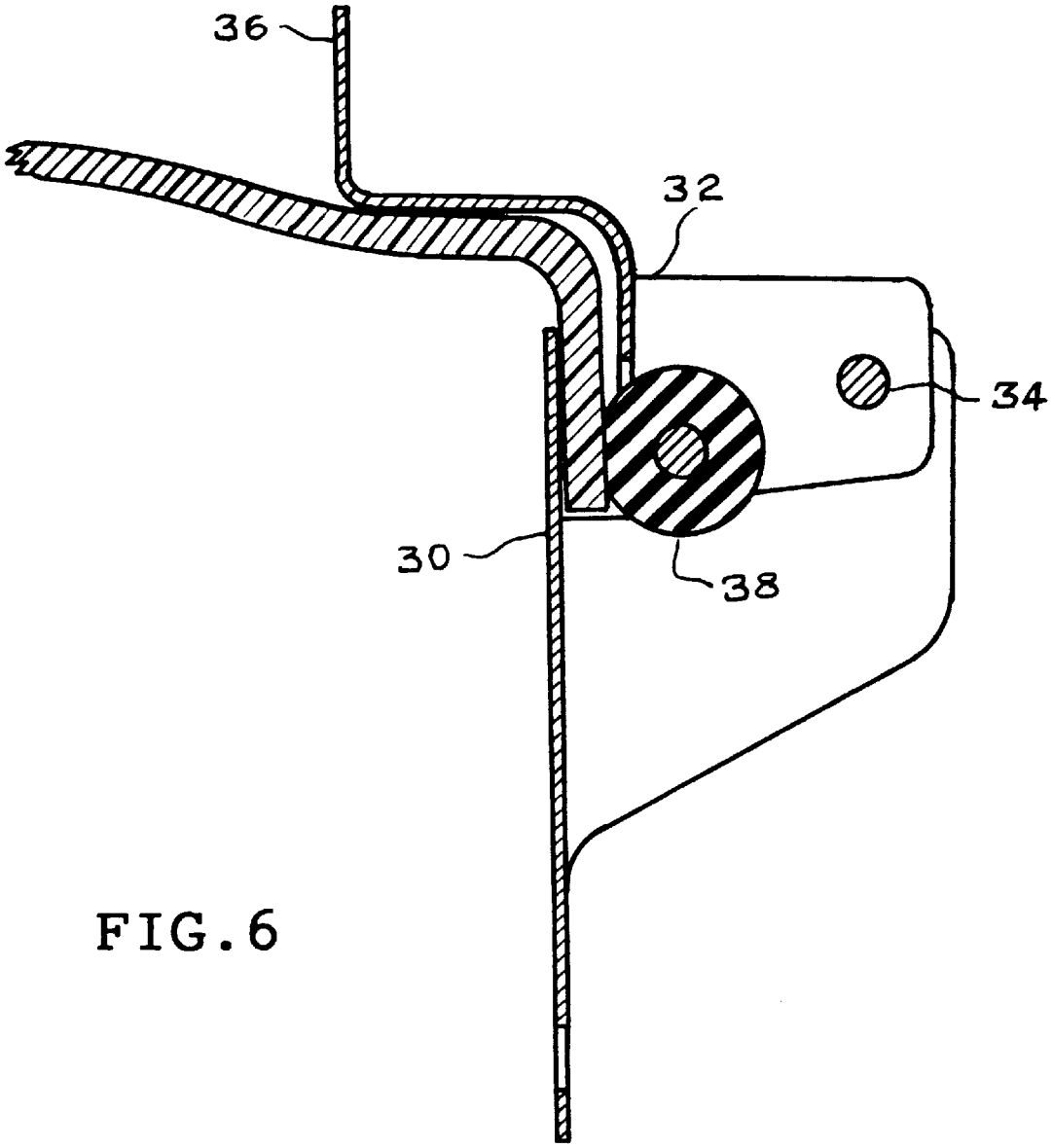
FIG. 6 is a sectional view of the lid attaching assembly as indicated by the broken line on FIG. 5, with a section of the plastic trash barrel lid added to show how it is gripped.

The lid attaching assembly 14 is shown in perspective in FIG. 5. There are two of these for the purpose of gripping both side edges of the trash barrel lid and transmitting the force delivered by the push rods to raise and lower the lid. The attaching assemblies are connected at the top ends of the vertical push rods by rotatable connectors. They are each comprised of two parts, as lid cradle 30 and a roller assembly 32 They are attached to each other by means of a hinge pin 34, which serves as a fulcrum when attaching or detaching the assemblies to the edge of the trash barrel lid. The roller assembly 32 supports a roller 38 by means of an axle supported between two flanges.

Attaching the lid controller to the trash barrel is accomplished by first placing the whole assembly on the surface in front of and adjacent to the trash barrel. The lid attaching assemblies 14 are then attached separately by first placing the lid cradle 30 snugly on the underside of the edge of the lid, then while holding this in place with one hand, rotate the roller assembly 32 over the top using rotation handle 36. This movement causes the roller 38 to come in contact with the outside surface of the lid and exert sufficient compression to give the attaching assembly a tight grip on the trash barrel lid. Further rotational movement of the roller 38 going beyond perpendicular to the lid surface locks the attaching assembly in position and secures the rotation handle 36 against the top of the lid.

With both attaching assemblies locked in place, the lid controller is ready for use. Pushing down on the leg operated lever 18 with either leg will open the lid to the full open position and slowly lifting the leg will control the closing of the lid.

For periodic emptying of the trash barrel, the lid controller will have to be removed. To accomplish this grasp the rotation handle 36 with the thumb and finger and rotate the roller out of the locked position. Both sides can be done simultaneously using both hands, followed by placing the push rods 22 in the holders 24. This operation is accomplished in a few seconds and the lid controller can then be lifted out of the way by grasping the lever assembly at the midpoint.

What I claim as my invention is:

1. A separate, self contained, trash barrel lid controller comprising:

a platform base on which are mounted two pylons, each supporting a journal at the top which function as fulcrums, a lever mechanism having a pivotal axis supported by said journals of said two pylons, rigidly attached at it's center portion at right angles to a leg operated lever, and rigidly attached at its outer ends to two lifting arms at right angles which extend in a direction essentially opposite to said leg operated lever, two vertical push rods pivotally connected at their lower ends to the outer ends of said two lifting arms and each having an attaching hole at the upper end, two lid attaching assemblies pivotally connected to the upper end of said two vertical push rods.

2. The lid controller defined in claim 1 wherein all parts are connected and together make a free standing portable self contained structure, which is entirely separate from the trash barrels with which it may be used.

3. The lid controller defined in claim 2 wherein positioning said lid controller in front of and adjacent to relatively large, residential plastic trash barrels on a flat surface and attaching said two lid attaching assemblies to the sides of said trash barrel lid, the said leg operated lever may be used for selective pivotal raising and lowering of said lid, thus achieving hands free operation.

4. The lid controller defined in claim 2 wherein it being a separate, self contained structure, it may be transferred at will from functioning with one trash barrel to function with any other like kind trash barrel.

5. The lid controller defined in claim 1 wherein said two lifting arms have holders attached for securing said two vertical push rods when said trash barrel lid controller is not in use.

* * * * *